United States Patent [19]

Tanaka et al.

[11] Patent Number: 4,961,176

[45] Date of Patent: Oct. 2, 1990

[54] ULTRASONIC PROBE

[75] Inventors: Hideyuki Tanaka, Kawaguchi; Koetsu Saito, Tokyo; Ikuo Sakai, Kawasaki; Masami Kawabuchi, Yokohama, all of Japan

[73] Assignee: Matsushita Electric Industrial Co., Ltd., Japan

[21] Appl. No.: 447,491

[22] Filed: Dec. 7, 1989

[30] Foreign Application Priority Data

Dec. 9, 1988 [JP] Japan ..... 63-312227

[51] Int. Cl.[5] ..... H04R 17/00

[52] U.S. Cl. ..... 367/155; 310/334; 310/369; 128/24 A; 128/660.01; 128/660.09

[58] Field of Search ..... 367/157, 153, 155, 905; 310/369, 336, 334, 322; 128/660.01, 660.05, 660.09, 24 A, 660.08, 660.07, 661.02

[56] References Cited

U.S. PATENT DOCUMENTS

| | | | |
|---|---|---|---|
| 3,457,543 | 7/1969 | Akervold et al. | 367/155 |
| 4,395,652 | 7/1983 | Nakanishi et al. | 310/334 |
| 4,523,471 | 6/1985 | Lee | 310/334 |

OTHER PUBLICATIONS

"Analysis of the Directional Pattern of Dynamic Focusing Transducers" by M. Ueda et al; The Journal of the Acoustical Society of Japan vol. 32, no. 6, Jun. 1976.

*Primary Examiner*—Charles T. Jordan
*Assistant Examiner*—J. Woodrow Eldred
*Attorney, Agent, or Firm*—Lowe, Price, Leblanc, Becker & Shur

[57] ABSTRACT

An ultrasonic probe includes a first group of one or more piezoelectric elements extending concentrically, and a second group of one or more piezoelectric elements extending concentrically and extending outward of the elements in the first group. The elements in the first and second groups form a front surface via which ultrasonic wave is transmitted and received. The elements in the first and second groups are separated by predetermined gaps. Areas of the respective elements in the second group over the front surface are substantially equal to each other within an accuracy corresponding to areas of the gaps over the front surfaces. Areas of the respective elements in the first group over the front surface are substantially equal to half the areas of the respective elements in the second group within an accuracy corresponding to the areas of the gaps.

6 Claims, 5 Drawing Sheets

ULTRASONIC PROBE

BACKGROUND OF THE INVENTION

This invention generally relates to an ultrasonic probe for an ultrasonic system, and specifically relates to an ultrasonic probe moved mechanically to generate a "B-mode" image of an examined object.

In some ultrasonic systems, an ultrasonic probe is mechanically moved to generate a "B-mode" image of an examined object.

The Journal of the Acoustical Society of Japan Vol. 32, No. 6, Jun. 1976, pages 355–361 discloses such a ultrasonic probe. As will be explained later, the prior-art ultrasonic probe of this Journal has problems.

SUMMARY OF THE INVENTION

It is an object of this invention to provide an excellent ultrasonic probe.

According to this invention, an ultrasonic probe includes a first group of one or more piezoelectric elements extending concentrically, and a second group of one or more piezoelectric elements extending concentrically and extending outward of the elements in the first group. The elements in the first and second groups form a front surface via which ultrasonic wave is transmitted and received. The elements in the first and second groups are separated by predetermined gaps. Areas of the respective elements in the second group over the front surface are substantially equal to each other within an accuracy corresponding to areas of the gaps over the front surface. Areas of the respective elements in the first group over the front surface are substantially equal to half the areas of the respective elements in the second group within an accuracy corresponding to the areas of the gaps.

BRIEF DESCRIPTION OF THE DRAWINGS

FIG. 3(*b*) is a sectional view of the piezoelectric element array of FIG. 3(*a*).

DESCRIPTION OF THE PREFERRED EMBODIMENT

Before a detailed description of this invention, the prior-art ultrasonic probe will be explained for a better understanding of this invention.

Figure 3A:
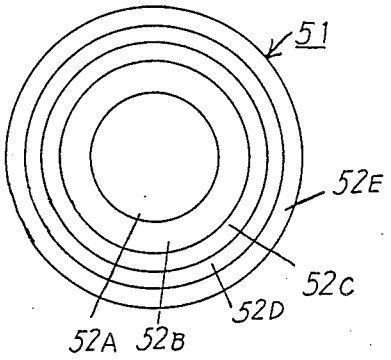
FIG. 3(a) (PRIOR ART)
FIG. 3(*a*) is a plan view of a piezoelectric element array in a prior-art ultrasonic probe.
Figure 3B:
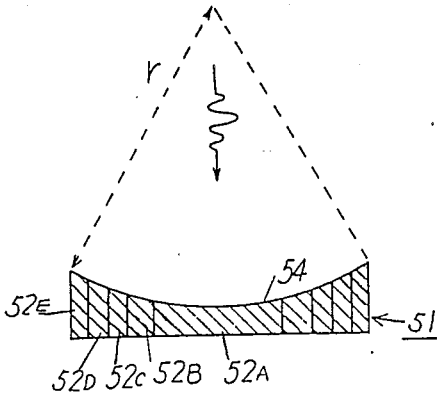
FIG. 3(b) (PRIOR ART)

As shown in FIGS. 3(*a*) and 3(*b*), a first example of the prior-art ultrasonic probe includes a piezoelectric element array (a transducer element array) 51 which has a central disk piezoelectric element (a central disk transducer element) 52A and ring piezoelectric elements (ring transducer elements) 52B, 52C, 52D, and 52E concentrically extending around the central piezoelectric element 52A. A pulse beam of ultrasonic wave is transmitted from and received by the piezoelectric element array 51. The piezoelectric elements 52A–52E form a front surface 54 via which the ultrasonic wave beam is transmitted and received. The transmission/reception surface 54 is concaved to structurally focus the transmitted and received ultrasonic wave beams. The radius of the curvature of the transmission/reception surface 54 is equal to a predetermined value "r". In addition, the areas of the respective piezoelectric elements 52A–52E which extend over the transmission/reception surface 54 are set approximately equal to each other. In general, the ultrasonic wave beam is also focused through signal processing called "electronic focusing". The electronic focusing offers suitable delays to output signals from the respective piezoelectric elements and then combines the delayed signals.

Figure 4:
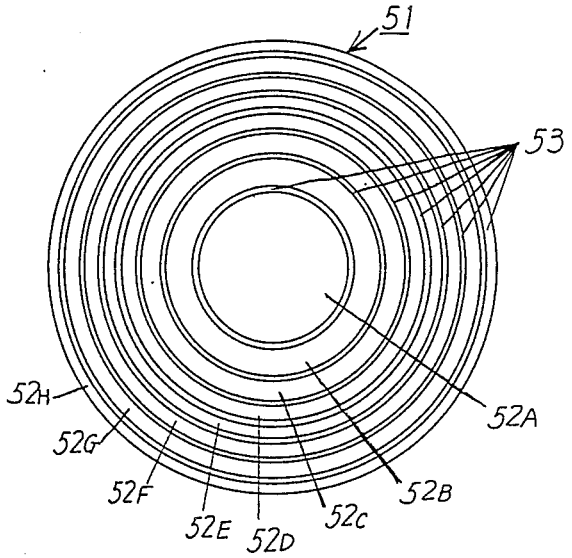
FIG. 4 (PRIOR ART)
FIG. 4 is a plan view of a piezoelectric element array in another prior-art ultrasonic probe.
Figure 5:
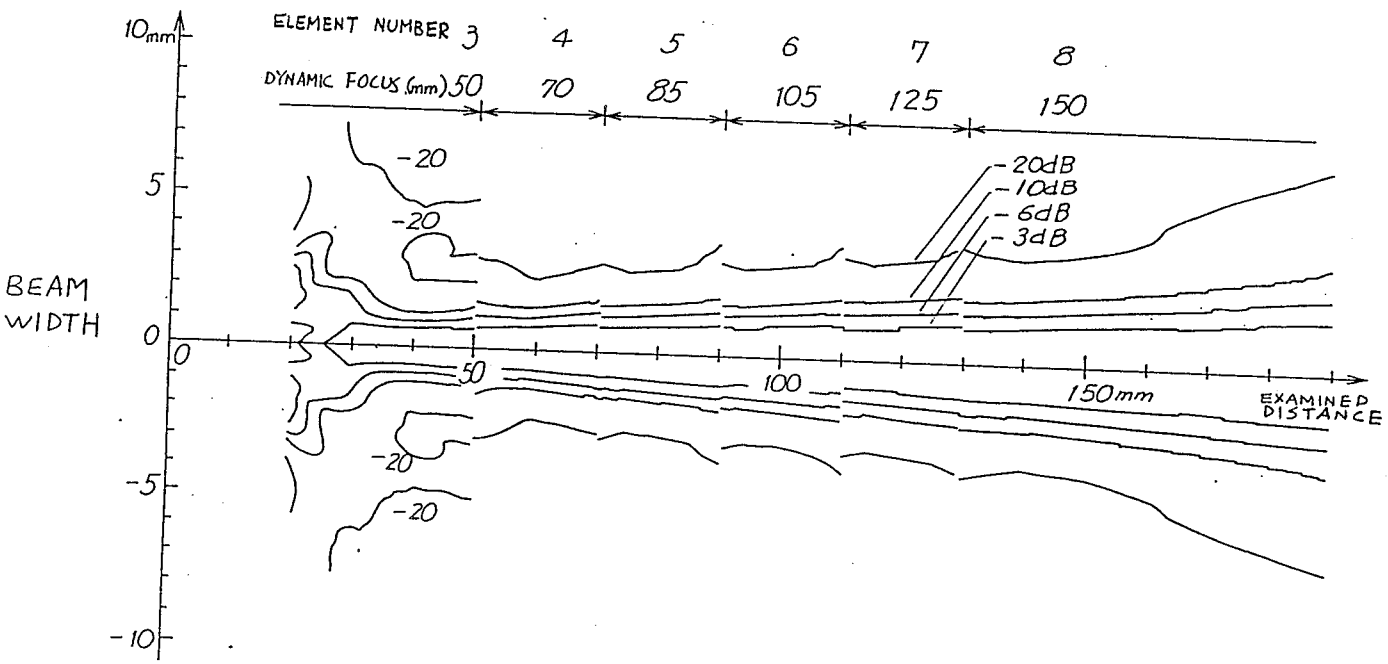
FIG. 5 (PRIOR ART)
FIG. 5 is a diagram showing results of a computer simulation of dynamic focusing in the ultrasonic probe of FIG. 4.

FIG. 4 shows a second example of the prior-art ultrasonic probe which is basically similar to the the prior-art ultrasonic probe of FIGS. 3(*a*) and 3(*b*). The prior-art ultrasonic probe of FIG. 4 includes a piezoelectric element array 51 of an eight-segment type. Specifically, the piezoelectric element array 51 has a central disk piezoelectric element 52A and ring piezoelectric elements 52B, 52C, 52D, 52E, 52F, 52G, and 52H concentrically extending around the central piezoelectric element 52A. The piezoelectric elements 52A–52H are separated by annular gaps 53. The piezoelectric elements 52A–52H form a concave transmission/reception surface. The areas of the respective piezoelectric elements 52A–52H over the transmission/reception surface are set approximately equal to each other. The dimensions of the piezoelectric elements 52A–52H are chosen as follows:

The outside diameter of the element 52A: 8.14 mm
The inside diameter of the element 52B: 8.54 mm
The outside diameter of the element 52B: 11.82 mm
The inside diameter of the element 52C: 12.22 mm
The outside diameter of the element 52C: 14.68 mm
The inside diameter of the element 52D: 15.08 mm
The outside diameter of the element 52D: 17.14 mm
The inside diameter of the element 52E: 17.54 mm
The outside diameter of the element 52E: 19.34 mm
The inside diameter of the element 52F: 19.74 mm
The outside diameter of the element 52F: 21.36 mm
The inside diameter of the element 52G: 21.76 mm
The outside diameter of the element 52G: 23.24 mm
The inside diameter of the element 52H: 23.64 mm
The outside diameter of the element 52H: 25.00 mm
The width of the respective gaps 53: 0.20 mm FIG. 5 shows results of a computer simulation calculating conditions of dynamic focusing which occurred while the prior-art ultrasonic probe of FIG. 4 was receiving echo signals. The dynamic focusing is explained in various published documents, for example, the Journal of the Acoustical Society of Japan Vol. 32, No. 6, Jun. 1976, pages 355–361. In the computer simulation related to FIG. 5: the transmission/reception surface of the piezoelectric element array 51 was defined as being flat so that the structural focal point was set infinitely distant; the central frequency of the echo signals was set to 3.5 MHz; the pulse length of the ultrasonic wave beam was set equal to three times the wavelength of the central-frequency ultrasonic wave; and the envelope of the pulses of the ultrasonic wave beam was of the half-sine shape or the half-sinusoidal form. In addition, this computer simulation ignored a nonlinear effect on the pulse propagation in an ultrasonic wave transmission medium.

It is seen from FIG. 5 that a beam width determined by −20 dB lines is relatively large and the degree of focusing is insufficient in an examined region of 0–50 mm although the ultrasonic wave beam is intended to be focused on an examined distance of 50 mm by use of the three inner piezoelectric elements 52A–52C. The insufficiently focusing is generally caused by a self-interference effect on each piezoelectric element.

In a prior-art ultrasonic probe such as shown in FIGS. 3(*a*) and 3(*b*) or FIG. 4, when an ultrasonic wave echo signal which is caused by the reflection of a transmitted ultrasonic wave beam at a closer point is required to be adequately focused through dynamic focusing, smaller areas of piezoelectric elements and a larger number of the piezoelectric elements are necessary. In this case, an electronic circuit connected to the ultrasonic probe tends to be complicated. Furthermore, the manufacture of the ultrasonic probe tends to be difficult since the width of the outermost ring piezoelectric element is extremely small.

Figure 1:
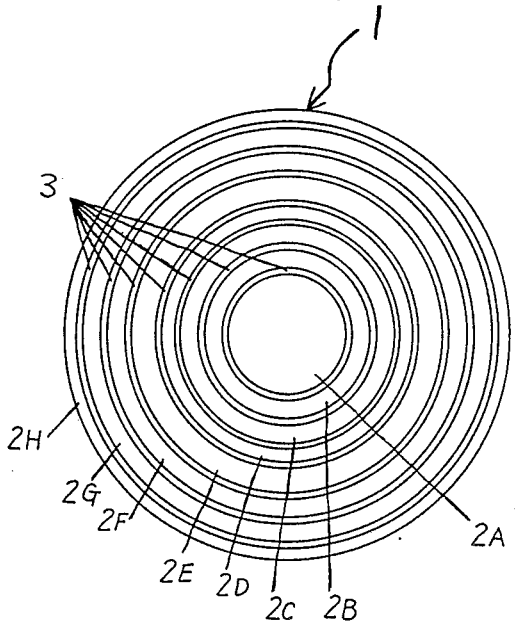
FIG. 1 is a plan view of a piezoelectric element array in an ultrasonic probe according to an embodiment of this invention.

This invention will now be explained in detail. FIG. 1 shows a part of an ultrasonic probe according to an embodiment of this invention. This embodiment is directed to an ultrasonic probe having a piezoelectric element array of an eight-segment type.

Figure 2:
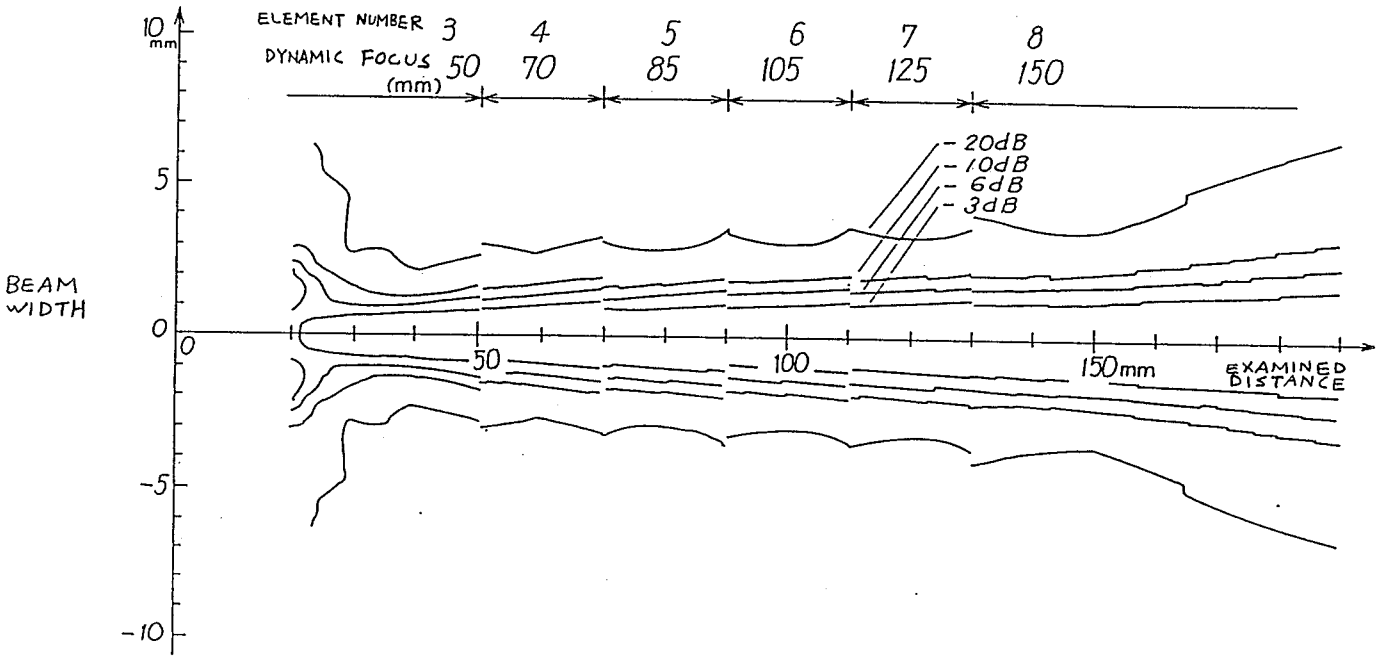
FIG. 2 is a diagram showing results of a computer simulation of dynamic focusing in the ultrasonic probe of FIG. 1.

The ultrasonic probe of FIG. 1 includes a piezoelectric element array (a transducer element array) 1 of an eight-segment type. Specifically, the piezoelectric element array 1 has a central disk piezoelectric element (a central disk transducer element) 2A and ring piezoelectric elements (ring transducer elements) 2B, 2C, 2D, 2E, 2F, 2G, and 2H concentrically extending around the central piezoelectric element 2A. During a scanning process, the piezoelectric element array 1 is mechanically moved within liquid in a direction perpendicular to its axis by a known drive mechanism (not shown). The piezoelectric elements 2A–2H are separated by annular gaps 3. The piezoelectric elements 2A–2H form a front transmission/reception surface which is concaved with a predetermined curvature in order to structurally focus transmitted and received ultrasonic wave beams. The areas of the outer piezoelectric elements 2E–2H over the transmission/reception surface are set approximately equal to each other within an accuracy corresponding to the areas of the annular gaps 3. The areas of the inner piezoelectric elements 2A–2D over the transmission/reception surface are set approximately equal to a half of the area of typical one of the outer piezoelectric elements 2E–2H within an accuracy corresponding to the areas of the annular gaps 3. Specifically, the dimensions of the piezoelectric elements 2A–2H are chosen as follows:

The outside diameter of the element 2A: 6.54 mm
The inside diameter of the element 2B: 6.94 mm
The outside diameter of the element 2B: 9.56 mm
The inside diameter of the element 2C: 9.92 mm
The outside diameter of the element 2C: 11.88 mm
The inside diameter of the element 2D: 12.28 mm
The outside diameter of the element 2D: 13.92 mm
The inside diameter of the element 2E: 14.32 mm
The outside diameter of the element 2E: 17.26 mm
The inside diameter of the element 2F: 17.66 mm
The outside diameter of the element 2F: 20.12 mm
The inside diameter of the element 2G: 20.52 mm
The outside diameter of the element 2G: 22.66 mm
The inside diameter of the element 2H: 23.06 mm
The outside diameter of the element 2H: 25.00 mm
The width of the respective gaps 3: 0.20 mm FIG. 2 shows results of a computer simulation calculating conditions of dynamic focusing which occurred while the ultrasonic probe of FIG. 1 was receiving echo signals. In this computer simulation: the transmission/-reception surface of the piezoelectric element array 1 was defined as being flat so that the structural focal point was set infinitely distant; the central frequency of the echo signals was set to 3.5 MHz; the pulse length of the ultrasonic wave beam was set equal to three times the wavelength of the central-frequency ultrasonic wave; and the envelope of the pulses of the ultrasonic wave beam was of the half-sine shape or the half-sinusoidal form. In addition, this computer simulation ignored a nonlinear effect on the pulse propagation in an ultrasonic wave transmission medium.

The ultrasonic wave beam is intended to be focused on an examined distance of 50 mm by use of the three inner piezoelectric elements 2A–2C. It is seen from FIG. 2 that a beam width determined by −20 dB lines is relatively small and the degree of focusing is sufficient in an examined region of 0–50 mm. In addition, since the diameters of the three focusing piezoelectric elements 2A–2C are smaller than the diameters of the three focusing piezoelectric elements 52A–52C of the prior-art ultrasonic probe 51 of FIG. 4, a beam width determined by −20 dB lines is larger than that of the prior-art ultrasonic probe 51 of FIG. 4 so that a balance of the ultrasonic wave beam is improved relative to that of the prior-art ultrasonic probe 51 of FIG. 4.

The previously-mentioned advantages of this invention which are shown in FIG. 2 denote unexpected results or unobviousness of this invention over the prior art.

What is claimed is:

1. An ultrasonic probe comprising a first group of piezoelectric elements extending concentrically; and a second group of piezoelectric elements extending concentrically and extending outward of the elements in the first group; wherein the elements in the first and second groups form a front surface via which ultrasonic wave is transmitted and received; the elements in the first and second groups are separated by predetermined gaps; areas of the respective elements in the second group over the front surface are substantially equal to each other within an accuracy corresponding to areas of the gaps over the front surface; and areas of the respective elements in the first group over the front surface are substantially equal to half the areas of the respective elements in the second group within an accuracy corresponding to the areas of the gaps.

2. An ultrasonic probe comprising a first group of transducer element extending concentrically; and a second group of transducer elements extending concentrically and extending outward of the elements in the first group; wherein the elements in the first and second groups form a front surface via which ultrasonic wave is transmitted and received; areas of the respective elements in the second group over the front surface are substantially equal to each other; and areas of the respective elements in the first group over the front surface are substantially equal to half the areas of the respective elements in the second group.

3. An ultrasonic probe comprising: a central disk piezoelectric element and a plurality of ring piezoelectric elements, spaced by annular gaps, concentrically extending around the central piezoelectric element; wherein the ring piezoelectric elements include an outer group of ring piezoelectric elements having areas that are approximately equal to each other and an inner group of ring piezoelectric elements having areas that are approximately equal to half of the area of the outer piezoelectric elements.

4. An ultrasonic probe as claimed in claim 3, wherein the inner group of ring piezoelectric elements includes, a first inner element having an outside diameter of 6.54 mm, a second inner element having an inside diameter of 6.94 mm and an outside diameter of 9.56 mm, a third inner element having an inside diameter of 9.92 mm and an outside diameter of 11.88 mm, and a fourth inner element having an inside diameter of 12.28 mm and an outside diameter of 13.92 mm; the outer group of ring piezoelectric elements includes, a first outer element having an inside diameter of 14.32 mm and an outside diameter of 17.26 mm, a second outer element having an inside diameter of 17.66 mm and an outside diameter of 20.12 mm, a third outer element having an inside diameter of 20.52 mm and an outside diameter of 22.66 mm, and a fourth inner element having an inside diameter of 23.06 mm and an outside diameter of 25.00 mm; and the width of the annular gaps is 0.20 mm.

5. An ultrasonic probe comprising: a central disk piezoelectric element and a plurality of ring piezoelectric elements, spaced by annular gaps, concentrically extending around the central piezoelectric element; wherein the ring piezoelectric elements include an outer group of ring piezoelectric elements having areas that are approximately equal to each other within an accuracy correspond to the areas of the annular gaps and an inner group of ring piezoelectric elements having areas that are approximately equal to half of the area of the outer piezoelectric elements within an accuracy corresponding to the areas of the annular gaps.

6. An ultrasonic probe as claimed in claim 5, wherein the inner group of ring piezoelectric elements includes, a first inner element having an outside diameter of 6.54 mm, a second inner element having an inside diameter of 6.94 mm and an outside diameter of 9.56 mm, a third inner element having an inside diameter of 9.92 mm and an outside diameter of 11.88 mm, and a fourth inner element having an inside diameter of 12.28 mm and an outside diameter of 13.92 mm; the outer group of ring piezoelectric elements includes, a first outer element having an inside diameter of 14.32 mm and an outside diameter of 17.26 mm, a second outer element having an inside diameter of 17.66 mm and an outside diameter of 20.12 mm, a third outer element having an inside diameter of 20.52 mm and an outside diameter of 22.66 mm, and a fourth inner element having an inside diameter of 23.06 mm and an outside diameter of 25.00 mm; and the width of the annular gaps is 0.20 mm.

* * * * *